United States Patent [19]

Lilja et al.

[11] 4,168,157

[45] Sep. 18, 1979

[54] PROCESS FOR THE SUSPENSION SMELTING OF SULFIDE CONCENTRATES

[75] Inventors: Launo L. Lilja, Pori; Simo A. I. Mäkipirtti, Nakkila; Valto J. Mäkitalo, Pori, all of Finland

[73] Assignee: Outokumpu Oy, Outokumpu, Finland

[21] Appl. No.: 888,777

[22] Filed: Mar. 21, 1978

[30] Foreign Application Priority Data

Apr. 6, 1977 [FI] Finland ..... 771109

[51] Int. Cl.[2] ..... C22B 1/10; C22B 1/11

[52] U.S. Cl. ..... 75/26; 75/6; 75/9

[58] Field of Search ..... 75/26, 6-9, 75/72

[56] References Cited

U.S. PATENT DOCUMENTS

| | | | |
|---|---|---|---|
| 2,813,015 | 11/1957 | Thornhill | 75/9 |
| 3,796,568 | 3/1974 | Szekely | 75/72 |
| 3,957,484 | 5/1976 | Fekete | 75/6 |

*Primary Examiner*—P. D. Rosenberg

*Attorney, Agent, or Firm*—Brooks, Haidt, Haffner & Delahunty

[57] ABSTRACT

A process for the suspension smelting of sulfide concentrates by causing a suspension flowing downwards in a suspension reaction zone to impinge against the surface of a melt below the suspension reaction zone in order to unload the solid and molten particles of the suspension into the melt and by causing the gases to flow further in the suspension reaction zone countercurrently in relation to the suspension in order to discharge the gases from the upper section of the suspension reaction zone, in which sulfide concentrate and oxygen or oxygen-enriched air are fed into the suspension reaction zone symmetrically and in the form of so dense a suspension spray that the iron oxide of the high-temperature suspension is in a molten state and absorbs the free oxygen present in the suspension before the suspension, at a temperature of at least 1400° C., unloads into the melt, the heat is recovered indirectly in the suspension reaction zone from the gases rising symmetrically and smoothly around the suspension, and the melt is fed from the suspension reaction zone into a separate melt reaction space.

5 Claims, 4 Drawing Figures

Fig. 3 Cu - Fe - S - O - $SiO_2$ system
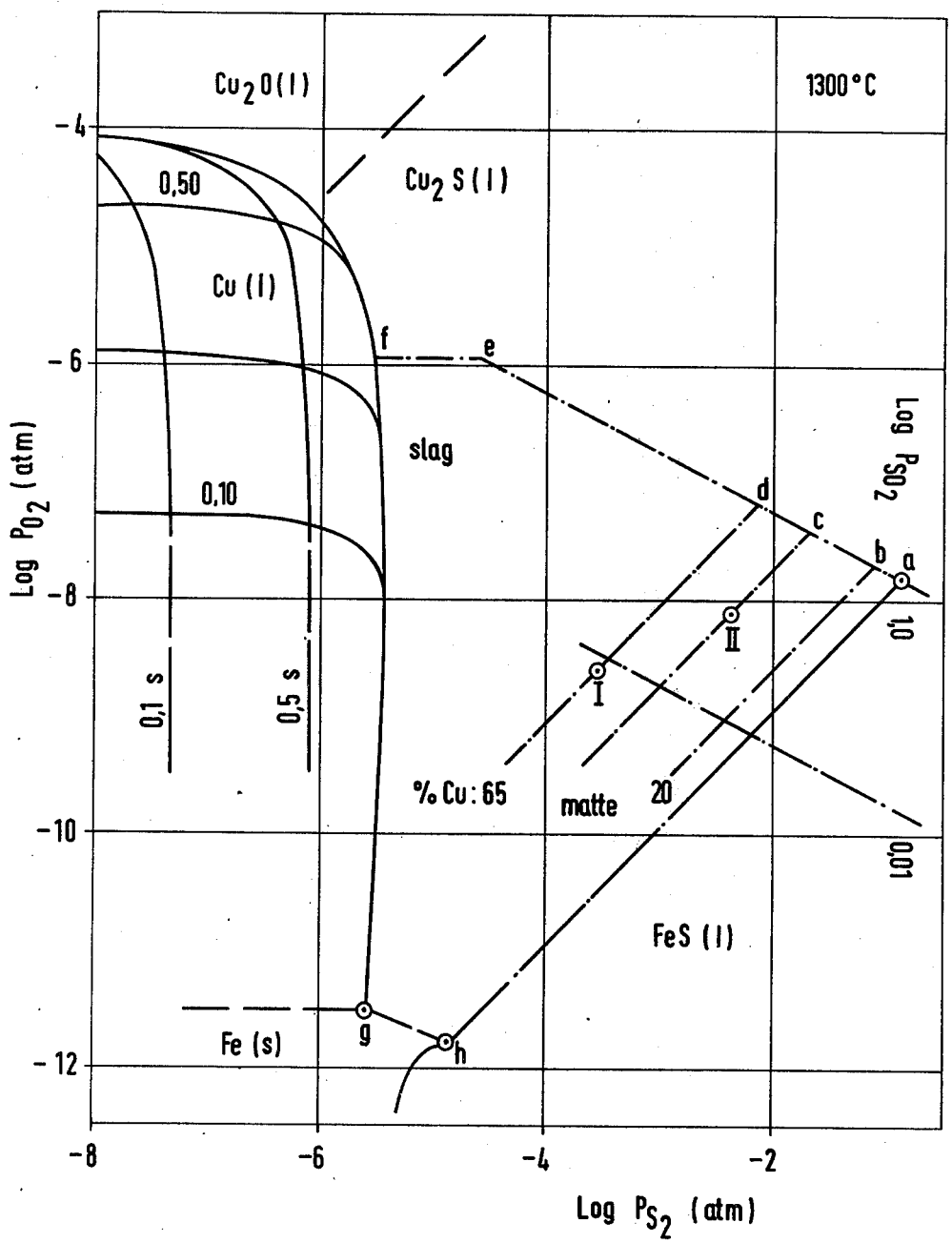

PROCESS FOR THE SUSPENSION SMELTING OF SULFIDE CONCENTRATES

BACKGROUND OF THE INVENTION

The present invention relates to a proces for the suspension smelting of ferriferous sulfide concentrates.

The horizontal, free-injection suspension processes according to U.S. Pat. Nos. 578,912 and 1,164,653 operating with cold and preheated air can be regarded as the basic methods for suspension roasting and smelting of sulfide concentrates. The fitting of a vertical suspension oxidation shaft in the vault of a reverberatory furnace has been suggested in publication Trans. AIME, 106, 1933, 104–110 (F. Laist, J. P. Cooper). The grounds for using oxygen-enriched air in the smelting of concentrates of copper and nickel have been given in publication Eng. and Min. Journ., 137, 1936, 499–502, 562–567 (T. E. Norman). Since the establishment of these basic principles of suspension techniques, and as a result of the general rise in the standards of technology, a large number of, for example, vertical suspension smelting processes have been created, and considerable improvements have also been made in these as knowledge of the art has increased.

Applications of the vertical suspension process according to both the cocurrent and the countercurrent principle include the processes acording to U.S. Pat. Nos. 2,040,682 and 2,209,331.

In general, the prior-known processes involve development of the suspension processes in order to produce higher-grade products than previously through improvements in both the process and the apparatus. The quality of the concentrates used in the suspension processes has constantly declined, while a higher degree of refining of the smelting products has been required.

Countercurrent processes are also well known in prior art. The oldest of these is probably that according to U.S. Pat. No. 1,888,164. In this process a sulfide concentrate, air and, when necessary, a fossil fuel are injected into a ceramic-lined furnace through the roof. Both the sulfur and the iron present in the concentrate are oxidized, and the smelting products thereby obtained are a molten metal phase and a molten slag phase at the base of the furnace. The reaction gases are removed through a channel in the wall of the upper section of the furnace; a heat exchanger has been provided in association with this channel for preheating the oxidation gases. The process specification does not include an example, and therefore it is not possible to evaluate the process and the operation of the smelting apparatus. It is obvious, however, that the quantity of metal obtained by the process is quite low.

In the countercurrent processes according to U.S. Pat. Nos. 2,040,682 and 2,209,331, elemental sulfur is recovered from pyrites, but the process can also be used for the treatment of sulfides of valuable metals and sulfide mattes. In the former process, which is a pure countercurrent process, a fossil fuel is used for the reduction of the sulfur dioxide gases. The completely roasted product is withdrawn from the lower end of the reactor by means of a screw (powder). In the latter process (Haglund), which includes both cocurrent and countercurrent operations, oxygen or oxygen-enriched air is used for the roasting of sulfides. The elemental sulfur is recovered from the obtained gas phase and the remaining sulfur dioxide is returned cocurrently or countercurrently to the system, and it reacts with molten sulfide, thereby releasing elemental sulfur.

The process according to Finnish Pat. No. 48202 (U.S. Pat. No. 3,900,310) already includes as an extreme case a flash-smelting furnace structure without a rising shaft; very finely-divided concentrates can be treated in it while maintaining the amount of flue dust at a moderate level. The process is thus a countercurrent process even though the concentrate and the oxidants are fed in parallel.

Of the process discussed, none is symmetrical in regard to suspension flows. In the processes which have a molten metal or sulfide phase as the product phase the suspension apparatus is in the same furnace zone as the melt.

In these prior-known processes, the suspension is a free suspension which is not rotating. Suspension flows which rotate vigorously are also used in vertical suspension processes, and naturally in all cyclone processes. There are methods of this type based on either the cocurrent principle or the countercurrent principle.

One example of the rotary-flow suspension processes carried out in a vertical shaft is Lange's suspension evaporation system (German Pat. No. 1,052,692). One countercurrent process which already very closely approaches cyclone processes is that according to British Pat. No. 1,001,310, which is used for the reduction and evaporation of zinc contents of slags and at lead smelting plants.

Water cooling devices are always used in cyclone apparatus because of the problems of lining due to the high temperature of the suspension. Since the oxidation product of the cyclone is driven to the walls of the cyclone by means of rotary flows, radiation heat exchangers are not suitable for them. Publications Tsvetnye Metally, 9, 1964, 30–39 (I.M. Rafalovich, V.L. Russo), Neue Hütte, 10, 1965, 210–216 (I. A. Onajew), Freiberger Forschungshefte, B 150, 1969, 41–65 (von Sch. Tschokin) and Erzmetall, 28, 1975, 313–322 (G. Melcher, E. Müller, H. Weigel) include good descriptions of both cocurrent and countercurrent cyclones in both horizontal and vertical apparatus. In the vertical cyclone suspension processes according to U.S. Pat. No. 3,555,164 and German Pat. No. 2,038,227, the cyclone gases and the product phases are separated from each other. Furthermore, in the processes the metal or matte space has been separated from the slag space by means of a partition wall, whereby the volatile products of the light-arc slag purification cannot come into contact with the sulfur dioxide gases. In the latter process, which is identical with the former, a complete roasting and smelting of the sulfide concentrate is carried out, in which case no sulfur is present in the valuable-metal bearing oxide melt to be reduced by electrical means.

One object of the present invention is to provide a process by which sulfide concentrates can be treated at high feed capacities in such a manner that the products obtained are sulfide mattes which are medium-grade in their valuable metal content, slags poor in valuable metals, and a gas phase which is sulfur dioxide of maximum purity directly suitable for liquefaction.

Using conventional suspension processes and technology it is difficult to meet all of these requirements simultaneously. High-capacity suspension smelting by means of oxygen results in very high heats of reaction difficult to extract from the reaction space. On the other hand, the systems corresponding to the partial pressures of sulfur dioxide have high oxygen potentials, and therefore the respective valuable-metal contents in the slags are uneconomically high. In applications of the cocurrent systems the transfer of heat by radiation from the suspension is low in spite of the high particle density, and during the process the autogenic lining derived from the shaft oxidation product accumulating on the walls of the furnace apparatus also effectively inhibits the operation of the cooling devices.

SUMMARY OF THE INVENTION

According to the invention, a suspension of sulfide concentrate and oxygen is fed into the reaction zone in the form of a suspension spray, precisely delimited in relation to the surrounding rising zone, the spray being so dense that the temperature of the suspension, before its impinging against the melt below, rises to such a level that the iron oxide present in the suspension is in a molten state, whereby it is capable of absorbing the free oxygen still remaining in the suspension. The high density of the suspension effectively prevents radiation of heat from the suspension and thereby makes its reaching a high temperature possible.

Heat is recovered effectively from the gases smoothly flowing upwards in the rising zone and substantially devoid of solid particles. Thereby the walls of the suspension reaction shaft are protected from heat and oxygen.

In order to produce the above-mentioned dense and precisely delimited suspension spray and the smoothly rising gas flow around it, it is important that the suspension is fed into the suspension reaction zone symmetrically with regard to the vertical axis of the reaction zone and the gases are also removed from it as symmetrically as possible. Currently used furnace constructions cannot fulfill these requirements.

Another essential characteristic of the present invention is that the melt reactions are performed in a melt reaction space separate from the suspension reactions zone.

DESCRIPTION OF THE INVENTION

Thus, when the present invention was being developed, it was possible, both theoretically and by practical trials, to solve the problems of the quantitative technical control of the countercurrent suspension system in a symmetrical flow system. The use of a symmetrical flow system partly limits the technical application of the process, but on the other hand it provides considerably advantages in terms of both metallurgy and thermal technology.

In a symmetrical flow system the suspension is injected at the upper section of a cylindrical or conical reaction space at a sufficient velocity and axially against the melt in the base of the lower section of the reaction space. Controlled flow technique makes it possible to predetermine the impinging points of the particles when the suspension unloads and thus also to control the process. After the suspension has unloaded only a minimum particle quantity, which can be optimized, remains in the gas phase. Thereafter the gas phase is directed, in a direction parallel to the reactor walls, into a rising flow countercurrent to the suspension flow. In order to achieve a smooth rising flow of the gas phase, the walls of the lower section of the reactor space and the gas outlets in its upper section have been dimensioned so as to produce a symmetrical flow.

When the suspension is injected, its flare angle is regulated by selecting the correct ratio of the nozzle orifice diameter of the suspension-feeding device to the reactor diameter in terms of flow principles and by selecting the velocity of the suspension at the nozzle so that the symmetrical, usually paraboloidal, suspension spray maintains its high physical density even during its oxidation. Owing to the thermal radiation thereby prevented, the temperature of the suspension can be raised to a range where the oxides of iron obtained as a result of oxidation are in a molten state. The remaining free oxygen present in the oxidation gases is thereby absorbed in a balanced manner into the oxide melt by using its ferrous-ferric iron reaction.

After the oxide reactions the reaction gas obtained after the unloading of the suspension has a sufficiently low concentration of free oxygen as not to damage the bare metal surface of the high-efficiency cooling devices which form the walls of the reaction space. Since the symmetrically rising gas-phase layer no longer contains a considerable quatity of oxidiation product particles after the suspension has unloaded and since the gas phase consequently has a low optical density, it is capable of radiating a desired portion of its heat content to the wall-cooling devices (e.g. a pressure vessel).

The oxidation product (shaft product) at a high temperature, unloaded from the suspension, is fed immediately from the reactor into a separate melt reaction space, where the oxide and sulfide phases of the shaft product react with each other, and the matte and the slag separate. In this case the high partial pressure of sulfur dioxide in the reactor system does not affect the settling of the product equilibriums. At the time that the suspension unloads, the heat content of the oxidation product is high enough for endothermal product reactions and for the thermal losses of their reaction space. The amount of additional heat required is in any case very low (a function of the composition of the concentrate). This considerably decreases the surface area of the shaft product reaction space, since the use of thin melt layers required by the transfer of additional heat can be eliminated.

DESCRIPTION OF THE DRAWINGS

FIG. 3 depicts the equilibrium diagram of the Cu-Fe-S-O-$SiO_2$ system as a function of the oxygen and sulfur pressures.

DESCRIPTION OF THE PREFERRED EMBODIMENTS

Figure 1B:
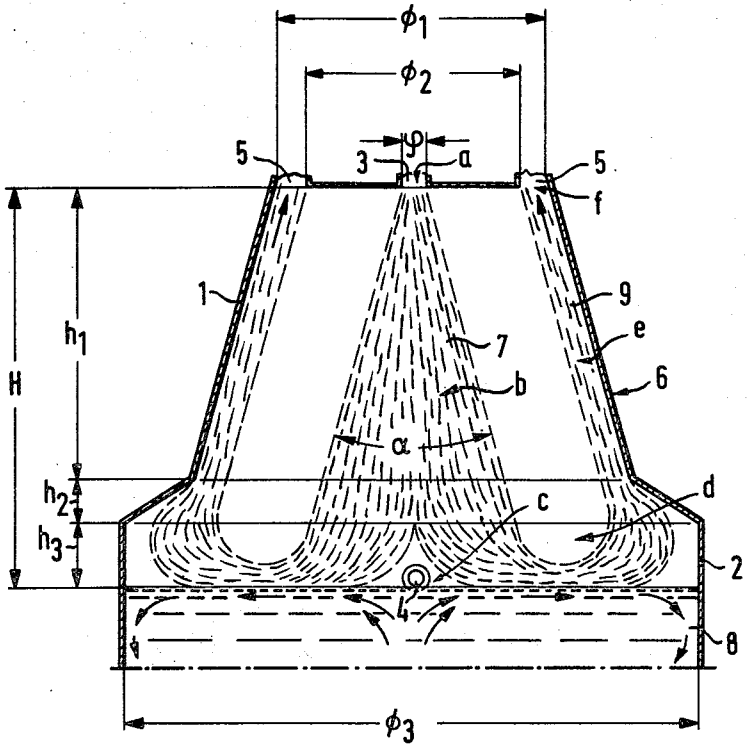
FIGS. 1*a* and *b* depict schematic cross sections of two suspension smelting furnaces intended for carrying out the process according to the invention.
Figure 1A:
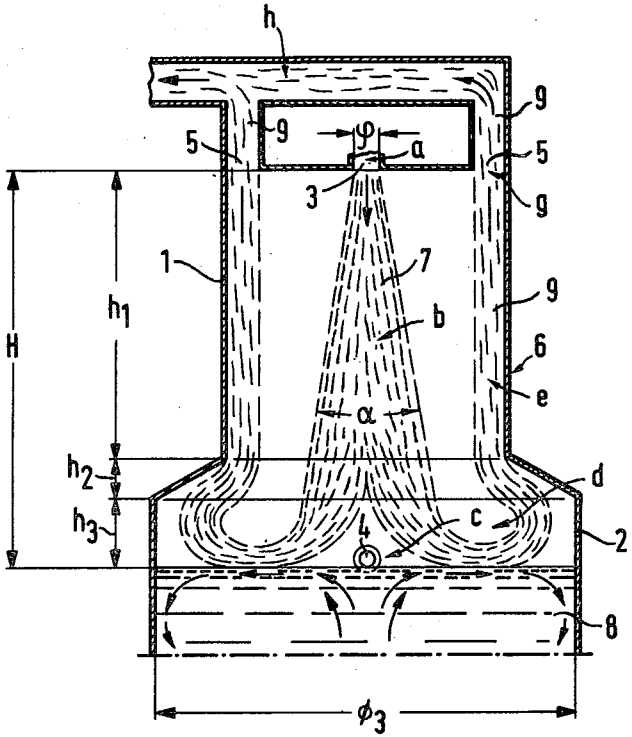

In the drawings, the upper section of the suspension reaction shaft 6 has been indicated by 1 and its lower section by 2, and as can be seen in FIGS. 1*a* and *b*, the narrower upper section 1 can be the shape of either a cylinder or a truncated cone. The furnace is fully symmetrical about a vertical axis, and the suspension feeding inlet 3 has been fitted centrally at its upper end and the gas outlet or outlets 5 are next to the wall of the reaction shaft 6, located annularly and at substantially regular intervals from each other. The outlet for melt 8 in the lower section 2 has been indicated by 4.

The suspension fed into the upper section of the suspension reaction space 6 forms a dense, paraboloidal spray 7 which is delimited with substantial precision; the spray 7 impinges against the surface of the melt 8 in the lower section 2, whereby the solid and the molten particles separate from the gases. First a toroidal turbulence forms in the gases and then they continue as a smooth flow 9 upwards along the walls of the suspension reaction shaft 6, the walls being covered with the cooling pipes (not shown in the figures).

In the process according to the invention an attempt has been made to solve the problems of controlled suspension oxidation and smelting of sulfide concentrates when using technical oxygen (98% $O_2$) or highly oxygen-enriched air. It has been possible, by using the process, to solve the problems of the required suspension physics, metallurgy and heat transfer. A very high-efficiency suspension smelting process for sulfide concentrates has thus been developed by using the countercurrent method, already known per se, in the suspension technique.

The new process has been based on applications, in a symmetrical flow system, of the results of the theory and measuring technique developed for the quantitative control of suspension flows. The control of suspension flows and the unloading of the suspension make possible both a high reaction temperature and the recovery of the heat content of the suspension by means of modern apparatus suitable for high-efficiency transfer of heat by radiation. The control of the smelting-apparatus suspension in the manner according to the process causes a substantial decrease in the quantity of flue dust in the outlet gases, a controlled unloading of the suspended particles to a desired position below the reaction space, an effective mixing of the unloaded materials in the molten phase, etc. The design and dimensioning of the smelting apparatus, correct in terms of flow technology, cause, after the unloading of the suspension, an even and smooth rising of the gas phase along the reactor walls, in which case the gas phase, which contains very little flue dust, is capable of discharging its thermal content by radiating directly to the high-efficiency cooling devices on the walls. The autogenic shaft-product linings produced on the reactor walls in the countercurrent and cyclone suspension processes are not produced at all in the new process. The high density of the suspensions in the said processes, which strongly inhibits electromagnetic radiation, is eliminated in the process under discussion by unloading the suspension at a high temperature before the recovery of the heat content of the gas phase. Before the unloading the temperature of the suspension is raised to such a level that the free oxygen possibly left in the gas phase after the reactions is absorbed by means of ferrous-ferric iron reactions of the molten oxides of iron.

The high shaft product temperature also effects a decrease in the total heat amount required by the matte-slag reactions in the system. The matte-slag reactions are carried out in a furnace apparatus separate from the actual smelting apparatus, whereby the high product-phase oxygen potentials caused in a high sulfur dioxide pressure and valuable-metal contents in slags are eliminated.

THEORETICAL DISCUSSION

The theoretical grounds for the new process are discussed in detail in order to make it clear.

The basic prerequisite for the new high-temperature countercurrent suspension smelting process is the quantitative control of the suspension flows. To achieve this, the symmetrical system according to the process is used. Even then the problems of applying flow techniques are very difficult.

In order to illustrate further the flow conditions in the system, they are examined with the aid of the flow positions (a–h) most crucial for the process in terms of the flow principles; they have been indicated in FIGS. 1*a* and *b*.

Position a

The suspension 7, composed of the concentrate and the oxidizing gas, is caused to flow into a shaft-like reactor at a velocity high enough to produce an impulse sufficient to cause the spray to penetrate as far as the melt surface. The suspension spray (or sprays) must be symmetrical in relation to the reaction shaft even if its travel direction before position a is at an angle to the axis of the reaction shaft.

Position b

The minimum value of the flare angle, $\alpha$, of the suspension spray 7 is dependent on the concentrate load and the surrounding conditions. In order that the flow in the shaft be stable, the diameter ($\phi_1$) of the upper section 1 of the shaft, the diameter ($\phi$) of the suspension spray 7 at position a, and the height (H) measured at shaft position a must fulfill the following condition:

$$\frac{H}{\phi_1} \leqq f' \frac{\frac{1}{2} - \frac{\Phi}{\phi_1}}{2 \tan(\alpha/2)}$$

where coefficient $f' > 1$.

The shape of the cross sectional area of the spray is determined both experimentally and by calculation methods known in flow technology.

Position c

At position c the flow lines of the suspension 7 curve, in which case the suspended molten- or solid-state particles in the spray tend, under the effect of forces acting on them, to detach from the flow and to impinge against the surface of the melt 8. The impinging point is determined by the properties and position of the particle in the cross sectional area of the spray. Knowing the physical properties of the suspended particles it is thus possible to predetermine with sufficient precision the desired impinging point in advance.

The gas flow parallel to the melt surface 8 produces a strong parallel melt surface movement, which causes, inside the melt 8, a movement corresponding to the flow lines indicated in FIGS. 1*a* and *b* and thereby an effective mixing of the melt (a phenomenon which is quite insignificant in conventional suspension systems).

Position d

In the process according to the invention the aim is, primarily because of principles of thermal technology, that the flow along the walls of the shaft is symmetrical. For this reason the lower section 2 of the shaft must also have a symmetrical shape. In order to produce a sufficient toroidal vortex at the turning point of the flow, position d, the lower section 2 of the shaft must be widened in accordance with FIGS. 1*a* and *b*. Thereby the rising flow becomes smooth (position e).

Position e

At position e the gas flow 9 is parallel to the shaft wall and its temperature is decreased owing to radiation. After the unloading of the suspension, the resultant force acting on the particles still left in the gas flow 9 and traveling along with it is parallel to the central axis in a cylindrical shaft and parallel primarily to the generatrix in a conical one.

Positions f, g, and h

Only position f is indicated in FIG. 1*b*. Positions g and h, which indicate the collecting and outlet channels for the outlet gases 9, are indicated in FIG. 1*a*. The rising flow of the gases 9, indicated by position e, is annular. Owing to requirements of flow principles, the gases at position f must, whenever possible, be removed from the system without changing the direction, extent, or shape of the flow, and thus in the ideal case as indicated in FIGS. 1*a* and *b*, through the annular opening 5 (position f) next to the shaft wall.

The following set of experiments is given as an example of the particle distribution in the product after the unloading of the suspension, as a function of the position of the unloading, and an example of the smoothness of the gas phase outlet flow (position f):

The initial values in the tests corresponding to FIG. 1 were: $H=1.2\ \phi_1$, $\phi=0.075\ \phi_1$, $\phi_3=1.5\ \phi_1$ and $h_3=0.375\ \phi_1$. The suspension spray was injected as a free spray not in rotary motion, at an initial velocity of 36.8 m/s, the solid material load being 2.43 kg of concentrate per 1.00 kg of air.

The table below shows the particle size distributions of the feed concentrate and of shaft product samples collected from below the shaft, at the melt surface level, at different distances from the shaft axis (% by weight, using Tyler's sieve series).

| Sieve mesh | Feed concentrate | Distance of sample extraction point from shaft axis: K . $\phi_1$ | | | |
|---|---|---|---|---|---|
| | | 0 | 0.127 | 0.318 | 0.508 |
| −100 | 91.75 | 84.40 | 71.96 | 96.19 | 99.31 |
| −200 | 56.40 | 25.52 | 17.91 | 59.53 | 83.03 |
| −400 | 26.47 | 7.91 | 4.62 | 24.02 | 42.57 |

The dust content values obtained for the outlet gases passing through the annular outlet 5 of the reaction shaft within six sectors of the same size were very evenly distributed (sector/dust, g/m$^3$): 1/140, 2/145, 3/140, 4/135, 5/144 and 6/145.

In this connection it is possible to discuss only the most essential features of the metallurgy of the new process. The most important of them are the behavior of the concentrate suspension during oxidation and the related reactions of the shaft oxidation product under the conditions of the process.

In conventional suspension oxidation, the operation is carried out within a range in which the iron oxides produced during the oxidation of iron sulfides are in solid state (wustite+magnetite) at the time the suspension unloads. Owing to the countercurrent principle applied in the new process, the suspension can be unloaded at a high temperature and in such a manner that the shaft product contains molten phases, with the exception of certain slag oxide components (CaO, $Al_2O_3$, etc.). Especially when using oxygen, the suspension spray 7 is so dense, both mechanically and optically, that electromagnetic radiation is not capable of transferring the heat content of the suspension, and thus the temperature of the suspension will not considerably decrease.

Molten iron oxide is used in the process for absorbing the free oxygen possibly left in the gas phase 9 during the oxidation of the concentrate, in accordance with equation $$FeO(FeO_{1.5}:1)+1/4O_2(g)\rightleftharpoons FeO_{1.5}(FeO:1)$$

Figure 2:
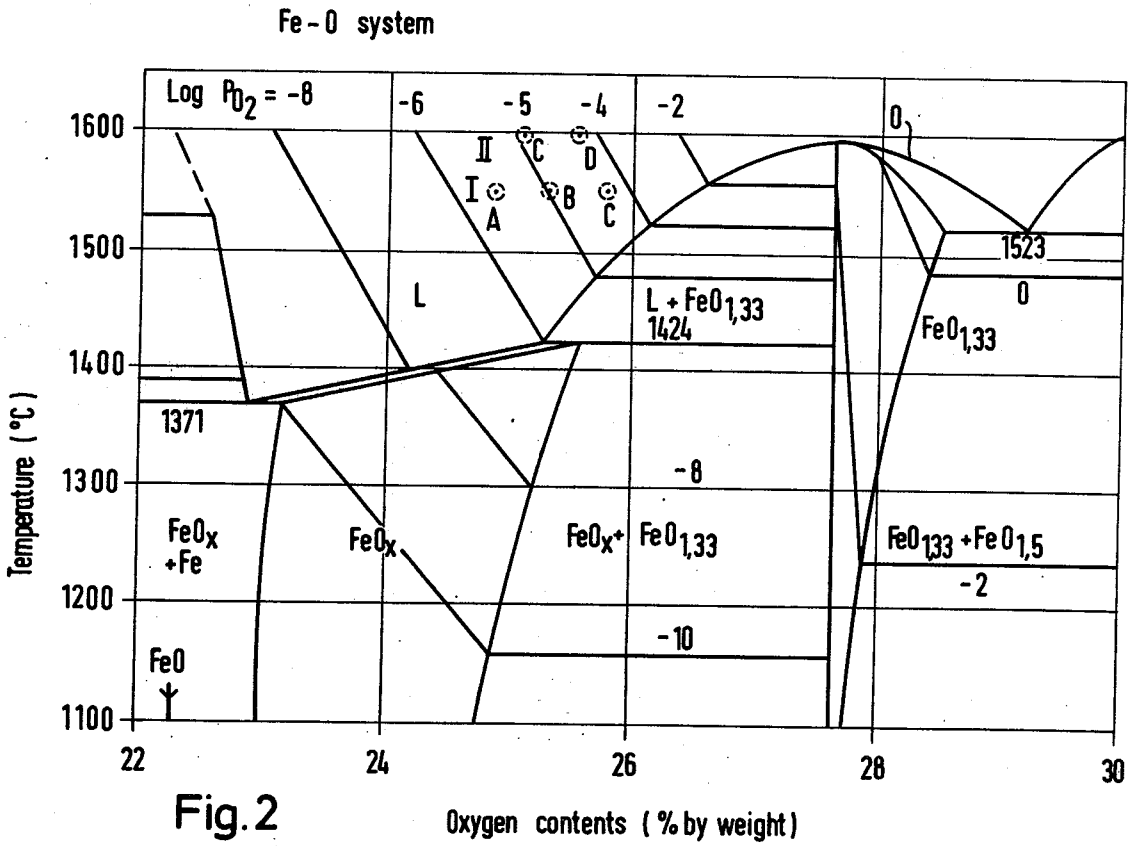
FIG. 2 depicts the equilibrium diagram of the Fe—O system as a function of the temperature and the oxygen concentration.

FIG. 2 shows the Fe-O system as a function of the temperature. The operation range of the process is the range of the Fe-O melt, i.e., using the notations in the figure (notation/oxygen concentration in % by weight-/temperature in °C.) as follows: a/22.3/1600°, b/22.9/1371°, c/25.3/1424° and e/27.6/1600°.

The equilibrium oxygen pressures corresponding to different compositions in the melt range are obtained as functions of the temperature:

$$\text{Log } P_{O2} = -(30400/T) + 11.080 + (7800/T)N_{FeO1.5} + 4\text{Log}(N_{FeO1.5}/N_{FeO})$$

At the oxygen concentrations involved, this is very exact as regards the oxide composition.

In Example I, illustrating the practical carrying out of the process (appended Tables 1–2), a $CuFeS_2$-$FeS_x$-$FeS_2$ concentrate is oxidized. According to our measurements, during the oxidation the iron sulfides are first oxidized to the FeS degree and chalcopyrite to the $Cu_2S$-FeS degree. Thereafter, the oxidation of iron follows quite closely the FeS-FeO pseudobinary. When oxidation has proceeded to a degree at which the FeS activity reaches the range $a_{FeS}=0.3$–$0.4$, the oxidation of iron sulfide slows down considerably, as the wustite obtained as a reaction product begins prevalently to oxidize to form magnetite. The reactions naturally take place within a very extensive temperature range as the suspension temperature rises continuously. In the case corresponding to Example I, the oxide phase of the shaft product (analysis: Table 1) corresponds to the composition $FeO_{1.157}$ (24.9% by weight O, $N_{FeO1.5}=0.313$) and thus to the oxygen pressure $P_{O2}=2.39\times10^{-6}$ atm (FIG. 2, point $I_A$). The concentration of free oxygen in the oxidation gas phase is, when medium-grade (50–70% Cu) sulfide mattes are produced, about 0.5–1.0% by vol. This free oxygen is absorbed into the molten oxide phase. Thereby the composition of the oxide phase of the example changes within the range $FeO_{1.183}-FeO_{1.213}$ (0% by weight: 25.34–25.79 and $N_{FeO1.5}$:0.366–0.426) and the oxygen pressure respectively within the range $P_{O2}=1.05-5.22\times10^{-5}$ atm (points $I_B$ and $I_C$ in FIG. 2). Unloaded, the shaft product of Example I corresponds to the composition $FeO_{1.18}$. According to FIG. 2, the melt system has a very wide absorption range, especially when medium-grade mattes are produced.

The absorption of free oxygen of the gas phase is very important in the countercurrent process used, since the steam pipes covering the walls of the reaction space cannot then oxidize and can therefore be used without covering ceramic layers. The particle content (flue dust) in the outlet gas phase 9 obtained according to the process is so low that it does not affect heat transfer, and the efficiency of the cooling apparatus is continuously at maximum. In the cocurrent and cyclone processes, an autogenic lining derived from the shaft product always forms on the walls, and this lining prevents even the heat transfer which would be possible by radiation through the dense suspension. The covering layer also causes a rise in the temperature of the interface between any cooling apparatus and the lining, whereby the sulfide in the shaft product lining damages the structural metal of the apparatus.

The shaft product obtained according to the process is at a very high temperature. Immediately after the unloading of the suspension, the reduction and slag-matte separation reactions begin in the shaft product. According to the process, the shaft product 4 flows, however, from the suspension reaction space into a separate reaction furnace (not shown). There the ferric iron in the product begins to be reduced by the sulfide in the shaft product, whereby the temperature of the product is lowered by the endothermal reduction reactions, for example, as follows according to the gross reactions:

$$FeS(l) + 6FeO_{1.5}(Fe_3O_4{:}s) + 3.5SiO_2(g) \rightleftharpoons 3.5Fe_2SiO_4(l) + SO_2(g)$$
$$\Delta H_R = 0.0847\ T + 239.6\ \text{Kcal/kg Fe}^{+3}$$

$$FeS(l) + 3Fe_3O_4(s) + 5SiO_2(S) \rightleftharpoons 5\ Fe_2SiO_4(l) + SO_2(g)$$
$$\Delta H_R = 0.1562\ T + 238.7\ \text{Kcal/kg Fe}^{+3}$$

$$FeS(l) + 6FeO_{1.5}(FeO_1SiO_2{:}l) \rightleftharpoons 7FeO(FeO_{1.5}SiO_2{:}l) + SO_2(g)$$
$$\Delta H_R = 0.0847\ T + 45.15\ \text{Kcal/kg Fe}^{+3}$$

When the reactions occur, both a thermal and a thermodynamic equilibrium is gradually approached between the slag, matte and gas phases.

FIG. 3 shows the stability field of the system Cu-Fe-S-O-SiO as a function of the sulfur and gas pressures in the gas phase at 1300° C., drawn with the aid of known thermodynamic functions.

In the calculations, the slag phase shown in the diagram has been treated as a normal solution (J. Lumsden: Thermodynamics of Molten Salt Mixtures, Academic Press, 1966, 312), in which case the values of the oxide activities and oxygen pressures are obtained with sufficient precision from the equations:

$$\text{Log } P_{O_2} = -(3901/T)\,(N_{FeO} - N_{FeO_{1.5}}) - 4\log(N_{FeO}/N_{FeO_{1.5}}) + (11546/T)N_{SiO_2} - (26512/T) + 11.083$$

$$\text{Log } \kappa_{FeO} = -(975/T)N^2_{FeO_{1.5}} - (3862/T)N_{FeO_{1.5}}N_{SiO_2} - (2187/T)N^2_{SiO_2}$$

$$\text{Log } \kappa_{FeO_{1.5}} = -(975/T)N^2_{FeO} + (1911/T)N_{FeO}N_{SiO_2} + (700/T)N^2SiO_2$$

The metal and sulfide melt equilibriums are partly based on new measurements (A. Yazawa, T. Azakami: Can. Met. Quar, 8, 1969, 257–261, Can. Met. Quar, 13, 1974, 443–444, T. Rosenqvist, T. Hartvig: Meddelelse No. 12 fra Metallurgisk Komite Trondheim, Norway 1958, 21–52, J. B. V. Bayley, N. E. Brown, F. A. Garner, S. G. Ward: Advances in Extractive Metallurgy and Refining, London, 1972, 81–94) (the scatter of the values continues to be great). The range of stable $SiO_2$-saturated sulfide solutions (matte phases) and iron silicate slags has been indicated by letters a-e-f-g-h in the diagram.

Equilibrium line segment a-h, which separates the ranges of iron sulfide and sulfide mattes, corresponds to the equilibrium:

$$FeS(l) + 1/2O_2(g) \rightleftharpoons FeO(l) + \tfrac{1}{2}S_2(g)$$

Lin segment a-e representing the isobar $P_{SO_2} = 1.0$ atm, at point e intersects equilibrium line segment f-e which corresponds to both magnetite and silicic acid saturation. The oxygen pressure corresponding to the saturation equilibrium $FeO(FeO_{1.5}, SiO_2{:}1) + 2FeO_{1.5}(FeO,SiO_2{:}1) = Fe_3O_3(s)$; $\Delta G = 0$ is $P_{O_2} = 1.14 \times 10^{-6}$ atm, and $a_{FeO_{1.5}} = 0.208$ The point, h, corresponding to iron and silicic acid saturation, i.e., the equilibrium $Fe(s) + 2FeO_{1.5}(FeO,SiO_2{:}1) = 3FeO(FeO_{1.5},SiO_2{:}1)$; $\Delta G = 0$ represents the oxygen pressure $P_{O_2} = 1.60 \times 10^{-12}$ atm and the FeO activity $a_{FeO} = 0.299$. The value $a_{FeS} = 0.66$ has been taken as the sulfide activity at point h. Point g represents the Fe(s)-Cu(1)-MeS(1) gas phase equilibrium, in which the following values have been taken as the corresponding melt compositions (% by weight): sulfide matte: 59.0 Cu, 18.9 Fe, and metal: 75.0 Cu, 20.4 Fe.

The position (FIG. 3, point 1) of the sulfide matte corresponding to Example I has been taken as corresponding to the FeS activity $a_{FeS} = 0.148$ and the pressure $P_{SO_2} = 1.0$ (point d) and has been drawn parallel to the line a-h. The values obtained for the corresponding equilibrium slag are $P_{O_2} = 2.53 \times 10^{-9}$ atm and $a_{FeO} = 0.329$. The slag phase is slightly undersaturated in regard to silicic acid. Directing the shaft product away from the high sulfur dioxide pressures of the smelting apparatus into a separate reaction furnace, as set forth in the new process, is an important operation. According to FIG. 3, a matte and slag phase corresponding to point d is in equilibrium with pure sulfur dioxide gas at atmospheric pressure. The equilibrium oxygen pressure of the system is in this case high ($P_{O_2} = 6.54 \times 10^{-8}$ atm) and so is respectively its valuable-metal content. The Nernst's distribution of copper in the matte and slag system follows the function:

$$\kappa_1/\kappa_2 = [P_{O_{2.2}}/P_{O_{2.1}}]^{\frac{1}{4}}$$

The Nernst's distribution of copper corresponding to Example I is $\kappa_{Cu} = 71$ (Table 1). Applying this equation, the value obtained for the distribution corresponding to point d is $\kappa_{Cu} = 32$. Thus the copper concentration in the slag would rise from the value of the example, 0.91% Cu, to approx. 2.1% Cu. The matte yield corresponding to the example is obtained as a result of conventional reduction reactions in an atmosphere devoid of $SO_2$. The equilibrium atmosphere of the products corresponds, in accordance with FIG. 3, to a $SO_2$ pressure of $P_{SO_2} < 0.01$ atm.

The description here of the practical implementation of the process is based on the use of an almost ideally dimensioned apparatus and the processing method according to the process specification.

The process and the apparatus can, however, be varied to some extent. In general, however, the apparatus must be dimensioned to correspond to the concentrate and the smelting capacity in order to meet the requirements of both processing and thermal technology. The smelting apparatus can, naturally, be used at capacities lower than the dimensioning values by accordingly ensuring that the capacity of the cooling apparatus is decreased or the oxidizing gas is preheated. The use of capacities higher than the nominal values is difficult, since the cooling apparatus does then not have the sufficient capacity for transferring the high amounts of heat generated. In this case nitrogen or other suitable gases must be used as cooling agents. Thereby, of course, the sulfur dioxide concentration in the gas phase obtained as a product decreases; for example, to a concentration corresponding to the oxygen enrichment of the air. The examples given here of the realization of the process have been limited to copper and nickel concentrates, but owing to the high temperature of the suspension, the process is, for example, very suitable for Pb- and Zn-bearing mixed concentrates and for complex concentrates which contain volatile impurities.

The suspension smelting apparatus necessary for carrying out the process must be dimensioned according to the requirements of the flow principles, in which case there is not much room for variation. Using the notations of FIGS. 1*a* and *b*, the dimensions of the furnace appratus corresponding to Examples I–III, expressed with the aid of the diameter ($\phi_1$) of the oxidation shaft, are as follows: $\phi_2=0.84\ \phi_1$, $\phi_3=1.50\ \phi_1$, $h_1=0.85\ \phi_1$, $h_2=0.15\ \phi_1$ and $h_3=0.35\ \phi_1$.

The walls and the combustion vault of the smelting apparatus consist of smooth-sufaced steam boilers, and the surface areas of their radiation surfaces are respectively: $1.74\times\pi\times\phi_1^2$ and $0.18\times\pi\times\phi_1^2$. The value obtained for the heat transfer of the mantle boiler in the apparatus used was $\alpha=115$ Mcal/m$^2$·h. The heat transfer value of the vault boiler varied, but on the average it was $\alpha=50$ Mcal/m$^2$·h. The heat transfer of the mantle boiler is, however, crucial for the process. The average heat transfer value of the smelting apparatus at the maximum capacity, using the said cooling apparatus, was: $Q=656\ \phi_1^2{}_{Mcal/h}$.

The shaft product obtained from the smelting apparatus is directed as an overflow into the matte-slag separation furnace. This can be a conventional reverberatory-type apparatus. Nevertheless, the process allows greater melt layer depths than those ordinarily used in the settling furnace, since the total heat of the shaft product obtained is sufficiently high to render a transfer of additional heat, which requires thin melt layers, unnecessary.

EXAMPLES

The examples illustrate the application of the new suspension process to the production of sulfide mattes, medium-grade in their valuable-metal content, from chalcopyrite and pentlandite concentrates. The results of the small-scale experiments in the examples have been applied to a large-scale industrial plant to best demonstrate the excellent advantages of the new process.

EXAMPLE I

In the case corresponding to Example I, chalcopyrite concentrate is smelted, using technical oxygen, to produce a 65-percent (by weight) copper matte and slag. Thereby a gas phase containing sulfur dioxide approx. 99% by vol. is obtained from the smelting unit, and after separation of dust this gas phase is suitable as such for liquefaction. The material and thermal balances of the smelting, calculated per one tonne of concentrate, are given in Tables 1 and 2. Owing to the smelting process, the shaft product and the gas phase with its flue dust leave the furnace space at different temperatures, and for this reason the thermal balance is given as functions of the temperature. In the case corresponding to the example, the concentrate feed was 25 t/h. The temperatures of the shaft product, the outlet gas phase, the matte, and the slag were respectively 1550° C., 1350° C., 1200° C., and 1250° C. The characteristic diameter of the smelting apparatus was $\phi_1=3.35$ m and height 4.53 m. The heat amount passing into the boilers of the smelting apparatus was 7380 Mcal/h. The surface area of the separate matte-slag separation furnace was 45 m$^2$ and its thermal losses 1160 Mcal/h. The value obtained for the amount of heat transferred by the cooling devices, calculated on the basis of the respective concentrate smelting capacity of 100 t/h, was 29500 Mcal/h. The characteristic diameter of the furnace is in this case $\phi=6.7$ m and its total height 9.1 m. The apparatus is thus very small.

EXAMPLE II

In the case according to the example, the process is applied to the smelting of a pentlandite concentrate to produce sulfide matte, slag, and sulfur dioxide. The grade of the matte was 40% Ni, Ni/(Cu+Ni)=0.9. The material and thermal balances corresponding to the example are in Tables 3 and 4.

The oxide portion of the shaft product obtained from the oxidation of the concentrate corresponds to the composition $FeO_{1.193}(N_{FeO1.5}=0.387)$ and at 1600° C. to the oxygen pressure $P_{O2}=4.53\times10^{-5}$ atm (FIG. 2, point $II_D$). The oxygen content in the original oxide melt has been lower than this, corresponding approximately to the composition $FeO_{1.17}(P_{O2}=1.23\times10^{-5}$ atm), i.e. an absorption of approx. 63.5 kg of oxygen by the melt (feed: 25.4 t/h). It can be observed from FIG. 2 that the extreme cases of the actual absorption are not involved until the production of iron-free mattes and metals.

The equilibrium oxygen pressure of the slag phase, calculated from the basic slag components, corresponds to the value $P_{O2}\sim7.24\times10^{-9}$ atm (1300° C.), a value which cannot deviate much from the actual value. The position of the nickel matte in the stability field of FIG. 3 (point II) corresponds to the iron sulfide activity $a_{FeS}=0.35$ and to a very low $SO_2$ pressure.

It should be mentioned that the Nernst's distributions between the sulfide matte and the slag in the case of the example are $\kappa_{Cu}=68, \kappa_{Ni}=61$, and $\kappa_{Co}=8$, values which correspond to the conventional equilibrium values in regard to the oxygen pressure. The quantitative distribution of nickel between the sulfide and oxide phases of the shaft product was approx. 85/15, a value which corresponds to the conventinal nickel oxidation rate at the matte concentrations involved.

In the case corresponding to the example, the shaft product was withdrawn at 1645° C. in order to produce the additional heat required by the matte-slag reactions. In other respects the product temperatures and the furnace apparatus correspond to those in the previous example.

EXAMPLE III

In Example III, a pentlandite concentrate smelting corresponding to Example II is carried out using a concentrate feeding rate higher than the nominal capacity (25 t/h) of the smelting apparatus i.e. 35 t/h, and an oxygen-enriched air for the oxidation.

598.4 kg of dry air per one tonne of concentrate was used for the smelting, the oxygen concentration in the air being 60.3% by vol. (63.44% by weight). The respective shaft product heat transfer equation obtained in thermal balance Table 4 is in this case $Q_I = 996.880 - 252.542 \times 10^{-3}T_1 - 185.869\ T_2$, Mcal. The quantity of outlet gas without the flue dusts is in this case 719 kg and its $SO_2$ concentration 50.0% by vol. (69.6% by weight) $SO_2$.

Table 1.

Smelting of chalcopyrite concentrate. Material balance.

Shaft reactions:

in (kg): Concentrate 1000.0, sand 163.0, flue dust 60.0, oxygen 371.1

Table 1.-continued

Smelting of chalcopyrite concentrate. Material balance.

out (kg): Shaft product 1063.5, gas phase 520.9

Product reactions:

in (kg): Shaft product 1003.5 out (kg): Matte 330.0, slag 657.0, gas phase 16.5

Analyses:

| Balance component | Analysis, % by weight | | | | | | |
|---|---|---|---|---|---|---|---|
| | Cu | Fe | $Fe^{+3}$ | S | O | $SiO_2$ | $O_x$ |
| Concentrate | 22.00 | 36.94 | — | 34.50 | — | 5.50 | 0.40 |
| Sand | — | 0.70 | 0.70 | — | 0.30 | 95.50 | 3.05 |
| Flue dust | 24.86 | 41.87 | (13.38) | 9.52 | (12.29) | 10.71 | 0.25 |
| Shaft product | 21.92 | 36.92 | 11.80 | 8.40 | 10.84 | 20.99 | 0.49 |
| Matte | 64.85 | 12.20 | 2.25 | 21.43 | 1.29 | — | — |
| Slag | 0.91 | 50.27 | 3.77 | 0.81 | 14.65 | 32.06 | 0.74 |

Table 2.

Smelting of chalcopyrite concentrate. Thermal balance.

Shaft reactions:

in ($\Delta H_s$, Mcal)

Feed mixture 1223.0 kg - 298 K $\Delta H = 1017.795$ out ($\Delta H_u$)

Shaft product 1063.5 kg - $T_1$ $\Delta H = 208.543 \times 10^{-3}T_1 + 165.585$ Gas phase 520.9 kg - $T_2$ $\Delta H = 111.791 \times 10^{-3}T_2 - 46.342$ Flue dust 60.0 kg - $T_2$ $\Delta H = 15.682 \times 10^{-3}T_2 + 16.314$ Thermal losses $Q_I$ Shaft balance: $\Delta H_s = \Delta H^u$. $Q_I = 882.238 - 208.543 \times 10^{-3}T_1 - 127.473 \times 10^{-3}T_2$ Product reactions:

in ($\Delta H_s$)

Shaft product 1003.5 kg - $T_1$ $\Delta H = 208.543 \times 10^{-3}T_1 + 165.585$ out ($\Delta H_u$)

Matte 330.0 kg - $T_3$ $\Delta H = 46.280 \times 10^{-3}T_3 + 205.896$

Slag 657.0 kg - $T_4$ $\Delta H = 179.020 \times 10^{-3}T_4\ 51.255$

Gas phase 16.5 kg - $T_4$ $\Delta H = 3.540 \times 10^{-3}T_4 - 1.468$

Thermal losses $Q_{II}$

Product balance: $\Delta H_s = \Delta H_u$.

$Q_{II} = 208.543 \times 10^{-3}T_1 - 46.280 \times 10^{-3}T_3 - 182.560 \times 10^{3}T_4 + 12.412$ Table 3.

Smelting of pentlandite concentrate. Material balance.

Shaft reactions:

in (kg): Concentrate 1000.0, sand 192.0, flue dust 55.0, oxygen 379.6 out (kg): Shaft product 1113.0, gas phase 500.5

Product reactions:

in (kg): Shaft product 1058.0 out (kg): Matte 142.0, slag 895.0, gas phase 22.6

Analyses:

| Balance component | Analysis, % by weight | | | | | | | | |
|---|---|---|---|---|---|---|---|---|---|
| | Ni | Co | Cu | Fe | $Fe^{+3}$ | S | 0 | $SiO_2$ | $O_x$ |
| Concentrate | 6.14 | 0.19 | 0.65 | 42.93 | — | 31.09 | — | 11.70 | 6.59 |
| Sand | — | — | — | 0.53 | 0.53 | — | 0.23 | 89.21 | 4.22 |
| Flue dust | 7.60 | 0.24 | 0.81 | 53.26 | (17.26) | 7.48 | (16.04) | 11.89 | 2.29 |
| Shaft product | 5.80 | 0.18 | 0.61 | 40.67 | 13.18 | 5.71 | 12.25 | 27.25 | 7.00 |
| Matte | 39.16 | 0.74 | 4.18 | 24.90 | 1.57 | 30.05 | 0.90 | — | — |
| Slag | 0.65 | 0.10 | 0.06 | 44.13 | 4.09 | 0.72 | 13.08 | 32.21 | 8.27 |

Table 4.

Smelting of pentlandite concentrate. Thermal balance.

Shaft reactions:

in ($\Delta H_s$, Mcal)

Feed Mixture 1247.0 kg - 298 K $\Delta H = 1035.082$ out ($\Delta H_u$)

Shaft product 1058.0 kg - $T_1$ $\Delta H = 252.542 \times 10^{-3}T_1 + 95.618$

Gas phase 500.5 kg - $T_2$ $\Delta H = 107.413 \times 10^{-3}T_2 - 44.529$

Flue dust 55.0 kg - $T_2$ $\Delta H = 12.143 \times 10^{-3}T_2 + 8.625$

Thermal losses $Q_1$

Shaft balance: $\Delta H_s = \Delta H_u$. $Q_1 = 969.115 - 252.542 \times 10^{-3}T_1 - 119.561 \times 10^{-3}T_2$ Product reactions:

in ($\Delta H_s$)

Shaft product 1058.0 kg - $T_1$ $\Delta H = 252.542 \times 10^{-3}T_1 + 95.618$ out ($\Delta H_u$)

Matte 142.0 kg - $T_3$ $\Delta H = 36.470 \times 10^{-3}T_3 + 141.168$

Table 4.-continued

| Smelting of pentlandite concentrate. Thermal balance. | | |
|---|---|---|
| Slag | 895.0 kg - $T_4$ | $\Delta H = 246.903 \times 10^{-3}T_4 - 42.707$ |
| Gas phase | 22.6 kg - $T_4$ | $\Delta H = 4.843 \times 10^{-3}T_4 - 2.008$ |
| Thermal losses | | $Q_{II}$ |
| Product balance: $\Delta H_s = \Delta H_u$. | | |
| $Q_{II} = 252.542 \times 10^{-3}T_1 - 36.470 \times 10^{-3}T_3 - 251.746 \times 10^{-3}T_4 - 0.835$ | | |

What is claimed is:

1. A process for the suspension smelting of sulfide concentrates containing iron, in which iron is oxidized to iron oxide, comprising: feeding sulfide concentrate and oxygen downward into a suspension reaction zone symmetrically with respect to a vertical axis of said reaction zone and in the form of so dense a suspension spray of particles and gases that iron oxide of the high-temperature suspension is in a molten state and absorbs free oxygen present in the suspension flowing downwards in the suspension reaction zone before the suspension impinges against the surface of a melt below the suspension reaction zone in order to unload solid and molten particles of the suspension into the melt; causing the gases to flow further in the suspension reaction zone smoothly and axially symmetrically upward around the suspension and countercurrently in relation to the downward flow of the suspension in order to discharge the gases from the upper section of the suspension reaction zone; recovering heat indirectly in the suspension reaction zone from the gases rising symmetrically and smoothly around the suspension; and feeding the melt from the suspension reaction zone into a separate melt reaction space.

2. The process of claim 1, in which, before the suspension is unloaded into the melt, the temperature of the suspension is at least 1400° C.

3. The process of claim 1, in which, before the suspension is unloaded into the melt, the temperature of the suspension is at least 1600° C.

4. The process of claim 1, in which a toroidal vortex is produced around the suspension unloading point in order to calm the gas flows before they are directed upwards.

5. The process of claim 1, in which the rising gas flow is discharged evenly and symmetrically in relation to the suspension feeding point.

* * * * *

UNITED STATES PATENT AND TRADEMARK OFFICE

CERTIFICATE OF CORRECTION

PATENT NO. : 4,168,157

DATED : September 18, 1979

INVENTOR(S) : Launo L. Lilja et al

It is certified that error appears in the above-identified patent and that said Letters Patent are hereby corrected as shown below:

Col. 10, line 8, "Lin" should be --Line--

Col. 14, Table 2, 5th line under Product reactions:, dash omitted from equation:

"179.020 x 10 - $^{3}T_{4}$ 51.255" should be --179.020 x 10 - $^{3}T_{4}$ - 51.255--

Signed and Sealed this

*Eleventh* Day of *March 1980*

[SEAL]

*Attest:*

SIDNEY A. DIAMOND

*Attesting Officer*

*Commissioner of Patents and Trademarks*